US005832794A

United States Patent [19]

Fowler

[11] Patent Number: 5,832,794

[45] Date of Patent: Nov. 10, 1998

[54] EXTENSION HANDLE APPARATUS FOR WRENCHES

[76] Inventor: Elbert J. Fowler, 303 Confederate Ave., Dallas, Ga. 30132

[21] Appl. No.: 835,408

[22] Filed: Apr. 8, 1997

[51] Int. Cl.[6] ..... B25B 23/16

[52] U.S. Cl. ..... 81/177.2; 81/177.2

[58] Field of Search ..... 81/177.1, 177.2, 81/176.1, 176.3, 180.1, 184, 185.2, 462, 489, 491, 129.5

[56] References Cited

U.S. PATENT DOCUMENTS

| | | | |
|---|---|---|---|
| D. 298,007 | 10/1988 | Williams et al. | D8/17 |
| 768,501 | 8/1904 | Winkelried | 81/129.5 |
| 905,650 | 12/1908 | Clarke et al. | 81/177.2 |
| 1,209,012 | 12/1916 | O'Brien | 81/176.3 |
| 1,511,738 | 10/1924 | Lownsbry | 81/177.2 |
| 2,490,739 | 12/1949 | Nesbitt | 81/177.2 |
| 4,104,935 | 8/1978 | Stoops | 81/177 |
| 4,644,600 | 2/1987 | Fugate | 7/166 |
| 4,729,281 | 3/1988 | Holloway, Jr. | 81/177.2 |
| 4,738,167 | 4/1988 | Ball | 81/124.2 |
| 5,033,337 | 7/1991 | Thomas, III | 81/177.2 |
| 5,535,649 | 7/1996 | Waggle, Jr. | 81/177.2 |

FOREIGN PATENT DOCUMENTS

| | | | |
|---|---|---|---|
| 308164 | 10/1918 | Germany | 81/177.2 |
| 735318 | 8/1955 | United Kingdom | 81/177.2 |

*Primary Examiner*—David A. Scherbel
*Assistant Examiner*—Joni B. Danganan
*Attorney, Agent, or Firm*—Joseph N. Breaux

[57] ABSTRACT

An extension handle apparatus for wrenches comprising an extension bar, a fixed support bracket fixedly coupled to the extension bar, and a moveable support bracket slidably coupled to the extension bar. The moveable support bracket comprises a sliding jacket member, first and second spring retaining protrusions and a locking spring wherein the moveable support bracket is moved along the length of a portion of the extension bar for accommodating a variety of wrench lengths.

1 Claim, 2 Drawing Sheets

EXTENSION HANDLE APPARATUS FOR WRENCHES

TECHNICAL FIELD

The present invention relates to extension handles for wrenches and, more particularly, to an extension handle apparatus for wrenches having a fixed support bracket and a moveable support bracket thereby accommodating a variety of wrench lengths. Moreover, the extension handle apparatus supports a wrench in the same plane of rotation as the wrench.

BACKGROUND OF THE INVENTION

There are many kinds of wrenches including single-ended wrenches, double-ended wrenches, box wrenches and the like. Wrenches are used to loosen and tighten nuts, pipes, etc. However, often it is difficult to reach nuts which are positioned in an obscure place. Therefore, extension handle apparatuses have been used to reach nuts in obscure places. The extension handle apparatuses of the prior art are awkward and cumbersome to use since the plane of rotation of the extension handle apparatus is not the same as the plane of rotation of the wrench.

Several devices have been patented which are aimed at extension handle apparatuses.

U.S. Pat. Nos. 5,033,337, 4,729,281, 4,644,600 and Design U.S. Pat. No. 298,007 are directed to an extension handle apparatus which provides an extension handle apparatus which is in the same plane of rotation as the wrench.

Other patents present in the art are U.S. Pat. No. 4,738,167 and U.S. Pat. No. 4,104,935 of which are directed to extension handle apparatuses, but do not meet the needs of the apparatus of the present invention.

SUMMARY OF THE INVENTION

The preferred embodiment of the extension handle apparatus for wrenches of the present invention solves the aforementioned problems in a straight forward and simple manner. What is provided is an extension handle apparatus for wrenches having a fixed support bracket and a moveable support bracket thereby accommodating a variety of wrench lengths. Moreover, the extension handle apparatus supports a wrench in the same plane of rotation as the wrench.

In particular, the extension handle apparatus for wrenches comprises an extension bar, a fixed support bracket fixedly coupled to the extension bar, and moveable support bracket slidably coupled to the extension bar. The moveable support bracket comprises a sliding jacket member, first and second spring retaining protrusions and a locking spring wherein the moveable support bracket is moved along the length of a portion of the extension bar for accommodating a variety of wrench lengths.

In view of the above, an object of the invention is to provide an extension handle apparatus which securely supports wrenches parallel to the plane of the extension bar.

Another object of the invention is to provide a moveable support bracket having a locking spring for engaging a side of the extension bar.

A further object of the invention is to provide an extension handle apparatus which accommodates single-ended wrenches, double-ended wrenches, box wrenches and the like.

It is a still further object of the invention to provide an extension handle apparatus which is easy to use, inexpensive and simple to manufacture.

The above objects and other feature of the present invention will become apparent from the drawings, the description given herein, and the appended claims.

BRIEF DESCRIPTION OF DRAWING

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
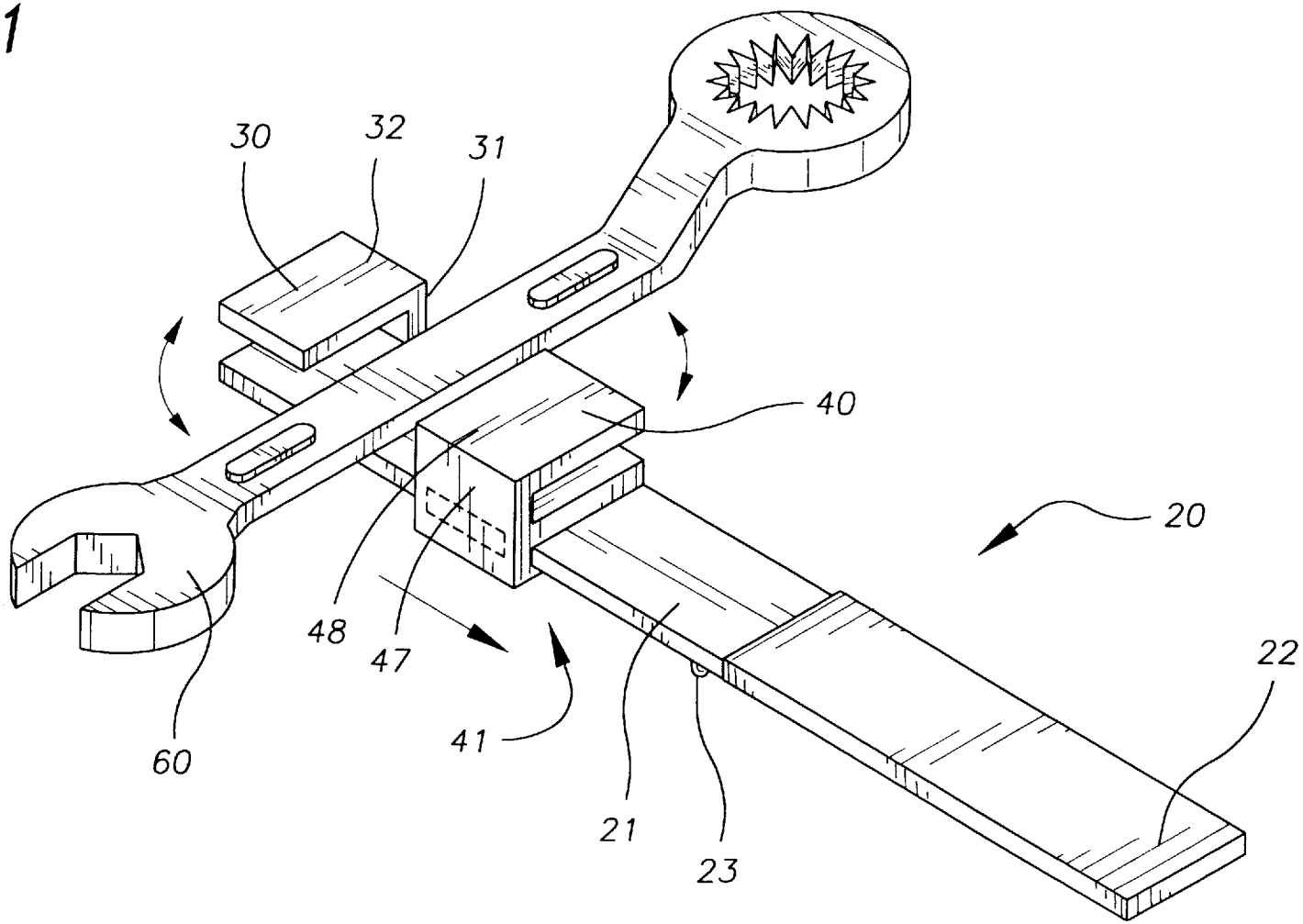
FIG. 1 illustrates a perspective view of the extension handle apparatus for wrenches wherein the wrench is a double-ended wrench.
Figure 3:
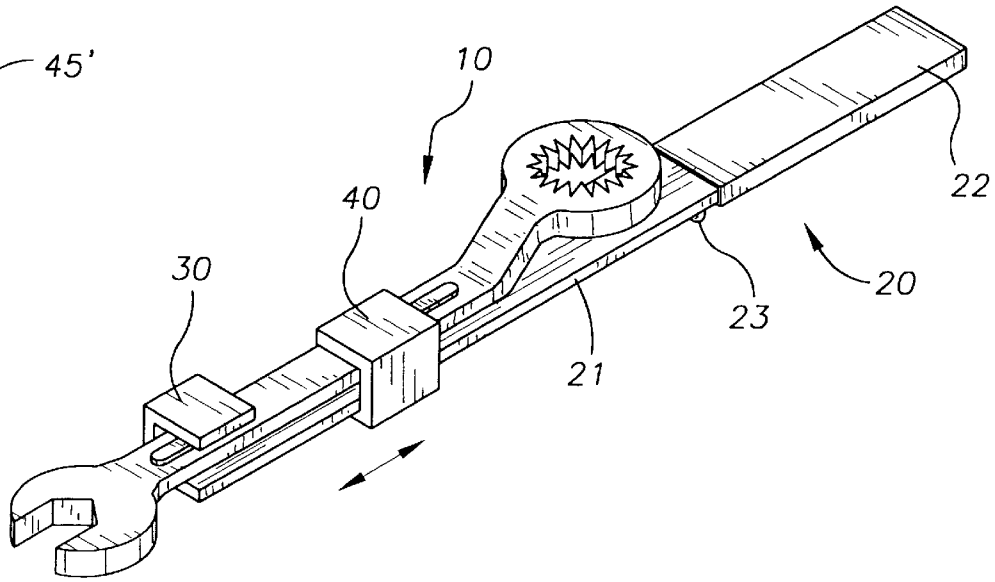
FIG. 3 illustrates a perspective view of the extension handle apparatus for wrenches wherein the wrench is fully supported.

Referring now to the drawings, and in particular FIGS. 1 and 3, the extension handle apparatus for wrenches of the present invention is designated generally by the numeral 10. Extension handle apparatus for wrenches 10 of FIGS. 1 and 3 is comprised of extension bar 20, fixed support bracket 30, moveable support bracket 40.

Extension bar 20 comprises flat rectangular wrench support member 21 and flat rectangular handle member 22. One distal end of flat rectangular wrench support member 21 is unitarily coupled to flat rectangular handle member 22 wherein flat rectangular handle member 22 has an outer perimeter slightly larger than the outer perimeter of flat rectangular wrench support member 21. Preferably, flat rectangular handle member 22 is coated with a protective plastic coating such as plastisol vinyl. The other distal end of flat rectangular wrench support member 21 has unitarily coupled thereto fixed support bracket 30.

Extension bar 20 further comprises stop protrusion 23 fixedly coupled to flat rectangular wrench support member 21 near said one distal end of flat rectangular wrench support member 21 wherein stop protrusion 23 prevents moveable support bracket 40 from sliding onto flat rectangular handle member 22 and off of extension bar 20. In the exemplary embodiment, stop protrusion 23 is fixedly coupled to a bottom surface of flat rectangular wrench support member 21. However, stop protrusion 23 may be fixedly coupled to the top surface or either of the side surfaces of flat rectangular wrench support member 21.

Fixed support bracket 30 comprises first bracket surface 31 and second bracket surface 32. One distal end of first bracket surface 31 is fixedly coupled perpendicularly to a side surface of flat rectangular wrench support member 21. The other distal end of first bracket surface 31 has fixedly coupled thereto perpendicularly second bracket surface 32 wherein second bracket surface 32 is parallel to the top surface of flat rectangular wrench support member 21.

Figure 2:
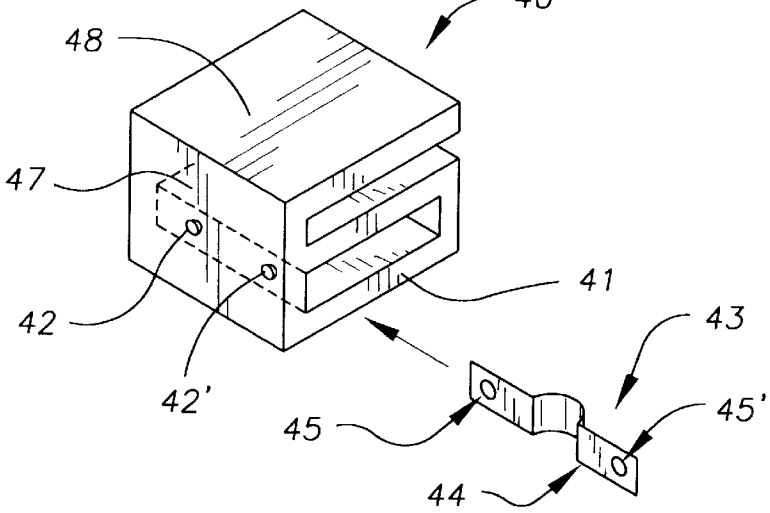
FIG. 2 illustrates a perspective view of the moveable support bracket of the embodiment of FIG. 1.

Referring to FIG. 2, moveable support bracket member 40 comprises sliding jacket member 41, first and second spring retaining protrusions 42 and 42' and locking spring 43. Sliding jacket member 41 comprises two short surfaces perpendicular to the top surface of flat rectangular wrench support member 21 and two long surfaces parallel to the top and bottom surfaces of flat rectangular wrench support member 21 for encapsulating flat rectangular wrench support member 21 so that sliding jacket member 41 slidably engages the surfaces of flat rectangular wrench support member 21. First and second spring retaining protrusions 42 and 42' are formed on one of the short surfaces of sliding jacket member 41 wherein first and second spring retaining protrusions 42 and 42' are substantially equidistant from each end of said one of the short surfaces.

Locking spring 43 is a spring metal component which has a length substantially the length of said one of the short surfaces and a width substantially the width of flat rectangular wrench support member 21. The center of locking spring 43 comprises engaging spring member 44 which engages a side surface of flat rectangular wrench support member 21 parallel to said one of the short surfaces thereby providing a friction engagement between locking spring 43 and the flat rectangular wrench support member 21. Locking spring 43 further comprises two apertures 45 and 45' on each end thereof for receiving therein first and second spring retaining protrusions 42 and 42', respectively.

Moveable support bracket member 40 further comprises first moveable bracket surface 47 and second moveable bracket surface 48. One distal end of first moveable bracket member 47 is unitarily coupled perpendicularly to the top surface of the long surface of sliding jacket member 41 such that first moveable bracket surface 47 is an extension of one of the two short surfaces wherein. The other distal end of first moveable bracket surface 47 has fixedly coupled thereto perpendicularly second moveable bracket surface 48 wherein second moveable bracket surface 48 is parallel to flat rectangular wrench support member 21. Additionally, first moveable bracket surface 47 is positioned at a side surface of flat rectangular wrench support member 21 opposite the side surface of first bracket surface 31 is positioned.

In operation, wrench 60 is placed perpendicular of the top surface of extension bar 20 between fixed bracket member 30 and moveable bracket member 40. Wrench 60 is rotated clockwise and is supported in place by fixed bracket member 30 and moveable bracket member 40. Wrench 60 is slid lengthwise along the top surface of flat rectangular wrench support member 21 until the desired protrusion of one distal end of wrench 60 from said one distal end of flat rectangular wrench support member 21 is obtained. Moveable bracket member 40 is adjusted along flat rectangular wrench support member 21 until adequate bracing support is maintained.

Preferably, for shorter wrench lengths which engage flat rectangular wrench support member 21, moveable bracket member 40 is positioned closer to fixed bracket member 30. For longer wrench lengths which engage flat rectangular wrench support member 21, moveable bracket member 40 is positioned closer to flat rectangular handle member 22.

It can be seen from the preceding description that an extension handle apparatus for wrenches which accommodates a variety of wrench sizes has been provided.

It is noted that the embodiment of the extension handle apparatus for wrenches described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A extension handle apparatus for wrenches comprising:

an extension bar comprising a flat rectangular wrench support member and a flat rectangular handle member;

a fixed support bracket fixedly coupled to said extension bar; and a moveable support bracket including a sliding jacket member slidably coupled to said extension bar;

said sliding jacket member comprising a first moveable bracket surface, a second moveable bracket surface, two short surfaces perpendicular to the top surface of said extension bar and two long surfaces parallel to the top and bottom surfaces of said extension bar for encapsulating a portion of said extension bar and wherein one distal end of said first moveable bracket surface is unitarily coupled perpendicularly to the top surface of one of the long surfaces for extending one of the short surfaces and the other distal end of said first moveable bracket surface 15 fixedly coupled thereto perpendicularly said second moveable bracket surface wherein said second moveable bracket surface is parallel to said extension bar said fixed support bracket comprising a first bracket surface and a second bracket surface wherein one distal end of said first bracket surface is fixedly coupled perpendicularly to a longitudinal side surface of said flat rectangular wrench support member and the other distal end of said first bracket surface has fixedly coupled thereto perpendicularly said second bracket surface wherein said second bracket surface is parallel to said rectangular wrench support member;

said first moveable bracket surface of said moveable support bracket being positioned at a longitudinal side surface of said flat rectangular wrench support member that is opposite an opposed longitudinal side surface of said flat rectangular wrench support member at which said first bracket surface of said fixed support bracket is positioned.

* * * * *